US009776034B2

(12) United States Patent
Higgins

(10) Patent No.: US 9,776,034 B2
(45) Date of Patent: Oct. 3, 2017

(54) EXERCISE APPARATUS

(75) Inventor: Douglas Higgins, Worcester (GB)

(73) Assignee: MUJO MECHANICS LIMITED, London (GB)

( * ) Notice: Subject to any disclaimer, the term of this patent is extended or adjusted under 35 U.S.C. 154(b) by 597 days.

(21) Appl. No.: 14/003,737

(22) PCT Filed: Mar. 7, 2012

(86) PCT No.: PCT/GB2012/050504
§ 371 (c)(1),
(2), (4) Date: Nov. 14, 2013

(87) PCT Pub. No.: WO2012/120299
PCT Pub. Date: Sep. 13, 2012

(65) Prior Publication Data

US 2014/0057761 A1 Feb. 27, 2014

(30) Foreign Application Priority Data

Mar. 9, 2011 (GB) ..... 1103990.6

(51) Int. Cl.

| | |
|---|---|
| ***A63B 21/00*** | (2006.01) |
| ***A63B 21/055*** | (2006.01) |
| ***A63B 23/035*** | (2006.01) |
| ***A63B 23/12*** | (2006.01) |
| ***A63B 21/062*** | (2006.01) |

(52) U.S. Cl.

CPC ..... *A63B 21/148* (2013.01); *A63B 21/00* (2013.01); *A63B 21/0552* (2013.01); *A63B 21/0628* (2015.10); *A63B 21/15* (2013.01); *A63B 21/155* (2013.01); *A63B 21/156* (2013.01); *A63B 21/4035* (2015.10); *A63B 21/4041* (2015.10); *A63B 21/4047* (2015.10); *A63B 23/035* (2013.01); *A63B 23/03525* (2013.01); *A63B 23/03533* (2013.01); *A63B 23/12* (2013.01); *A63B 23/1209* (2013.01); *A63B 23/1263* (2013.01); *A63B 23/0355* (2013.01)

(58) Field of Classification Search

CPC ..... A63B 21/00
USPC ..... 482/99, 98, 102, 103
See application file for complete search history.

(56) References Cited

U.S. PATENT DOCUMENTS

| | | | |
|---|---|---|---|
| 5,042,799 | A | 8/1991 | Stanley |
| 5,413,546 | A | 5/1995 | Basile |
| 5,486,150 | A | 1/1996 | Randolph |
| 7,645,216 | B2 | 1/2010 | Edeker |

(Continued)

FOREIGN PATENT DOCUMENTS

| | | |
|---|---|---|
| GB | 2223686 A | 4/1990 |
| WO | WO 2008/009949 | 1/2008 |

*Primary Examiner* — Gregory Winter
(74) *Attorney, Agent, or Firm* — Morgan, Lewis & Bockius LLP

(57) ABSTRACT

Muscle resistance apparatus comprising a framework, at least one resistive force and a movable section. The movable section is linked to a resistive force, wherein a first part of the movable section is attached to the framework by a connection whereby it can be temporarily displaced, and a second part of the movable section is connected to the first part of the movable section by a second connection whereby it can be temporarily displaced. The first and second parts of the movable section are independently movable with respect to one another in an angular and/or linear fashion.

13 Claims, 7 Drawing Sheets

(56) References Cited

U.S. PATENT DOCUMENTS

| | | | | |
|---|---|---|---|---|
| 2007/0037667 | A1 | 2/2007 | Gordon | |
| 2009/0143202 | A1* | 6/2009 | Carter | A63B 21/154 482/99 |
| 2011/0028283 | A1* | 2/2011 | Webber | A63B 21/0615 482/99 |
| 2013/0109543 | A1* | 5/2013 | Reyes | A63B 23/03558 482/99 |
| 2015/0094193 | A1* | 4/2015 | Lyszczarz | A63B 21/156 482/38 |

* cited by examiner

EXERCISE APPARATUS

CROSS REFERENCE TO RELATED APPLICATIONS

The present application is a U.S. National Phase of PCT Patent Application No. PCT/GB2012/050504, filed Mar. 7, 2012, and claims priority to European Patent Application No. GB1103990.6, filed Mar. 9, 2011, all of which are incorporated herein by reference in their entirety for all purposes.

FIELD OF THE INVENTION

This invention relates to improved exercise apparatus.

BACKGROUND TO THE INVENTION

A problem with some existing exercise apparatus is that there is little control over the direction and/or loading on the joints throughout the range of motion of the exercise.

Non-cam based fixed weight machines, free weights and cable machines, for example, are capable of training multiple joints, but provide a load that is fixed in a particular direction, which is defined by the direction of gravity, direction of the cable, and/or the movement of the mechanism; the load direction does not adjust with the user's movements. Therefore, as the user moves their limb, for example, the load might initially act perpendicularly to the motion but during the range of movement, the load acts at an angle away from perpendicular.

As a result, the, or each, joint is not fully loaded, thereby reducing the efficiency of the exercise. Additionally, because the user's joints are not supported with cable machines and free-weights, the user can be exercising using poor form, especially when tired, which may damage the joint and/or muscles.

Cam based machines, such as those made by Nautilus, load joints evenly throughout their range of motion using rotational loading applied at the joint by a cam. Such machines have been available for some time. A disadvantage of such machines is that they are restricted to one joint being exercised in one direction; only a single joint is exercised and multi-articular exercises are not possible.

U.S. Pat. No. 7,645,216 B2, in the name of William Kurt Edeker, discloses exercise machines that comprise pivoting parts comprising linked cam arrangements that allow for multi-joint exercises. One disadvantage of these machines is that they only operate in a single plane of motion and/or path of movement. A further disadvantage is that because the cams are linked, the parts that pivot to exercise the joints are dependently linked such that movement of one part induces or depends upon movement of another. By being dependently linked, the benefit of the machine on each joint is limited because a larger muscle group may compensate for a smaller muscle group, thereby reducing the effectiveness of the exercise. Furthermore, such training does not provide a load on the whole range of movement of at least one of the joints.

WO2008009949 (A1) discloses muscle conditioning apparatus for strengthening a user's cervical spine. However, its movement is limited to allow exercising of the back and the neck only.

SUMMARY OF THE INVENTION

Accordingly, the present invention is directed to muscle resistance apparatus comprising a framework, at least one resistive force and a movable section, the movable section being linked at least one position along its length to the, or each, resistive force, wherein a first part of the movable section is attached to the framework by a connection whereby it can be temporarily displaced, and a second part of the movable section is connected to the first part of the movable section by a second connection whereby it can be temporarily displaced, and wherein the first and second parts of the movable section are independently movable with respect to one another in an angular and/or linear fashion.

Because the movable parts are capable of independent movement, the exercise can work two or more muscle groups during the temporary displacement of the movable section, which may be two movements of the same joint or movement of two different joints. By exercising the joint or joints in two directions or planes, more of the muscle group is used, thereby exercising muscles that control multi-axial movement and multi-articular muscles that assist with movement in more than one joint.

The resistive force is engaged upon movement of each of the first and second parts independently. Therefore, if the first part is retained in a fixed position relative to the second part, movement of the second part engages the resistive force. Likewise, if the second part is retained in a fixed position relative to the first, movement of the first part encounters the resistive force. Therefore, although each part is movable without having to move the other part, the resistive force is always applied to the part that is moving. Thus, the user will always feel resistance when using the device, rather than encountering a passive movable part to which no resistance is applied. Additionally, the parts are not dependently linked such that movement of one part results in a definite and predictable movement of the second part.

The apparatus provides a semi-constrained functional environment for exercising at least one joint of the body. Good form can be maintained due to the assisted nature of the exercise, without limiting the movement to a single joint and/or plane of motion.

The apparatus allows for independent movement of the two parts, thereby improving on the prior art by allowing each joint to be fully loaded throughout ROM by applying rotational torque at both joints.

Linear movement, rather than, or in addition to, rotational movement may be desirable for at least one of the connections. This might be preferable for obtaining a swing motion that comprises both linear and rotational movement.

An independent moving cam is created using the present arrangement. That is to say that the cam moves along a path established by the first moving part and because the position of the cam changes with respect to the framework, the second moving part has a range of paths through which it may move, rather than a single predetermined path. The tension in the cable resists translational movement of the cam. The axis of the cam moves during the range of motion, rather than staying in a fixed position in space. Because the two parts are independently linked, the overall exercise performed by a user allows their natural movement to be more closely followed than if the parts are dependently linked.

It might be the case that an end point of the second movable section follows at least two arcuate paths during its full range of motion, the arcuate paths having different radii. Displacement of the first movable part creates a first arc and displacement of the second movable arc creates the second arc. Due to the difference in the respective lengths of the first and second parts, the radii of the resulting arcs will be different.

Preferably, at least part of the movable section is capable of multi-directional movement. This might be movement in two directions in a single plane, or movement in two different planes. For example, the two movements might both be in an arcuate fashion but having different radii. Alternatively, the movement may be linear and then arcuate, or vice versa.

It is preferable that the link between the movable section and the at least one resistive force comprises at least one cam. By having a cam in the link between the movable section and the resistive force the torque required by the user to overcome the resistance can be varied such that it is constant or varies according to a predetermined amount over the course of the range of motion of the movable section. The loading of the application of rotational torque at both joints (connections) may be effected by having the torque applied via a cam positioned at the second connection and the first connection being loaded via a tension in cable acting about the first connection. This may be especially advantageous for biarticular muscles that control movement across two joints; bicep, tricep, quadricep, hamstring, calf, etc.

Advantageously, the cam is positioned substantially adjacent to the second connection of the movable section. It is convenient for the cam to be positioned at the connection between the first and second movable parts and relatively easy to construct in such a fashion. This is particularly advantageous wherein it is preferred to have a greater torque effected upon the first part than is effected upon the second part.

Preferably, the overall effect of the cam, or cams, is that the force required to overcome the at least one resistive force is variable through the full range of motion of the movable section. By varying the force required to overcome the at least one resistive force the apparatus can be adjusted to best work a selected muscle group. For example, it may be desirable to have a muscle working more over the first part of the range of motion than during a subsequent part of the range of motion. By using the cam in combination with a multi-directional movable section, such profiles can be established. The torque in the second member can be adjusted by varying the radius and profile of the cam. The torque in the first part may be adjusted by varying the position of where the cam is attached to the first connection.

In one construction, the cam is connected to the first movable part at a position wherein the axis of the cam is offset from the axis of the connection and the cam is linked to the second movable part by way of a cable. By having the cam positioned along the first movable part the torque, or linear force, required to overcome the resistive force can be adjusted compared to having the cam positioned at the connection between the first and second parts, or along the length of the second movable part (which in itself may be desirable).

In one embodiment, the first connection and the second connection allow movement in substantially the same orientation, thereby allowing movement of the first and second parts of the movable section within a single plane. Such a construction may be useful for exercising an arm so that the shoulder and bicep are both used in a single plane; movements such as shoulder raises and bicep curls.

In an alternative arrangement, the first connection and the second connection are aligned to allow movement of the first part of the movable section within a plane selected from a group comprising sagittal, coronal and transverse planes, and to allow movement of the second part of the movable section within a different plane selected from the same group. Such a construction allows for multi-planar movement, thereby exercising one or more joints of a user's body in two, potentially perpendicular planes. This allows one to more closely replicate movements that naturally occur during sporting activity and movement of multi-axial joints, thereby providing support and guidance. This might be particularly useful in rehabilitation from injury.

It may be preferably that, when in use, the apparatus provides resistance to adduction of a first joint of the user's body and provides resistance to extension or flexion of a second joint of the user's body. Alternatively, when in use, the apparatus provides resistance to adduction of a first joint of the user's body and provides resistance to rotation of the same joint, or a second joint, of the user's body. Movements that reflect the body's natural movement are desirable when exercising one's muscles for a particular sport or movement.

Advantageously, the second connection of the movable section allows for axial rotation of the second part of the movable section relative to the first. By allowing the second part to rotate relative to the first part during the range of motion of the movable section, more natural movement may be obtained. As an example, the rolling of the arm whilst playing a shot in a racquet sport can be more accurately followed when rotation between the two parts is possible. A three-dimensional cam may be used to effect such motion between the parts, for example, so that rotational movement in the end of the second part might be possible.

Preferably, at least one connection allows at least one of the movable parts to swing. The swing may be a combination of rotational and linear movement or just rotational movement. Such movement allows for a path to be followed by the movable section that mimics that of the joints of a human or animal.

It is advantageous that the connection is a pivot. A pivot allows movement in a similar way to some joints in the human body and therefore it is advantageous for the apparatus to reproduce such movements. Furthermore, a pivot is a relatively simple connection to reproduce and easy to maintain.

BRIEF DESCRIPTION OF THE DRAWINGS

Embodiment of the invention will now be described, by way of example only, and with reference to the accompanying drawings, in which.

DETAILED DESCRIPTION OF EXEMPLARY EMBODIMENTS

Figure 1:
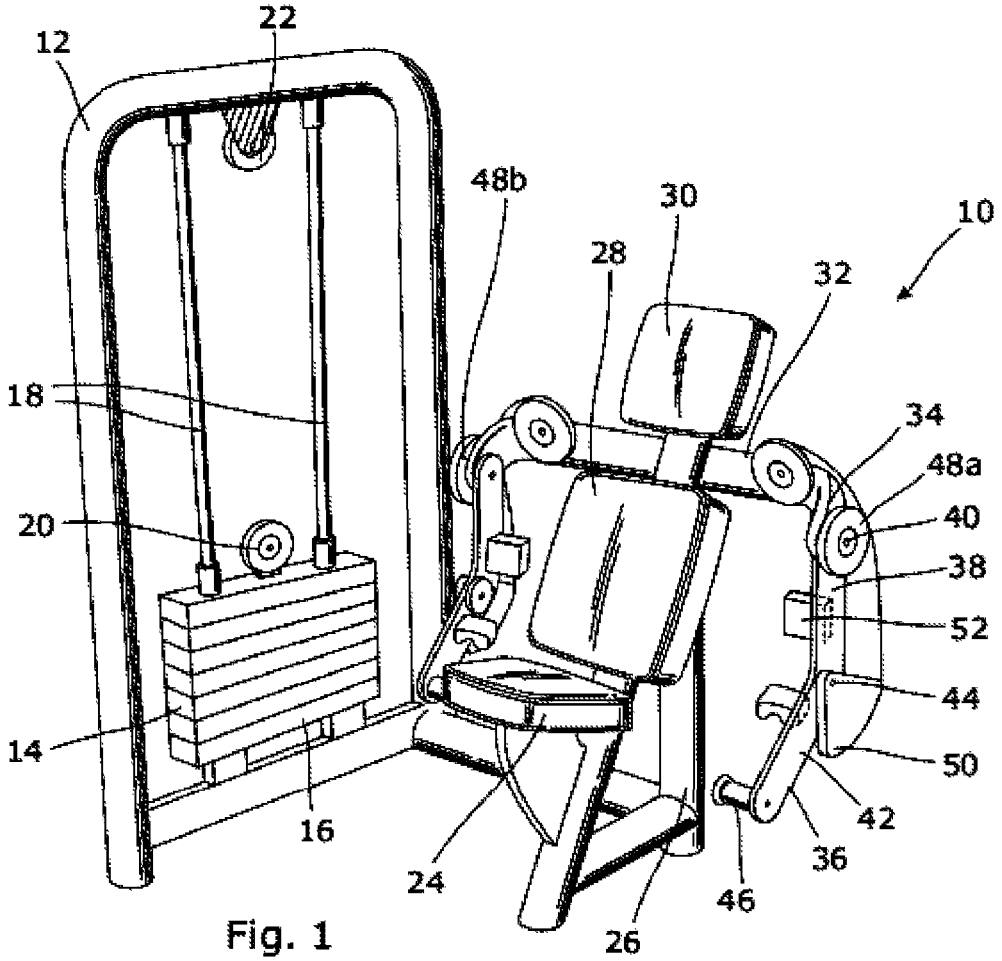
FIG. 1 shows a first embodiment of the present invention.

FIG. 1 shows a fixed-weight exercise machine 10, comprising a framework 12 housing a weight stack 14. The weight stack 14 is of a common construction known in the art and comprises rectangular plates 16 having recesses through which two substantially vertical shafts 18 pass. The mass required is selected by positioning a pin (not shown) horizontally through a plate 16 into a vertical shaft attached to the top plate of the weight stack 14 and descending down through the other weights 16 (not shown). The weight stack is connected to a pulley 20 on the uppermost plate 16. A second pulley 22 is connected to the framework in a position substantially vertically above the pulley 20.

A seat portion 24 is positioned perpendicularly to the weight stack 14. The seat portion 24 comprises a substantially vertical stanchion 26 to which a back support 28 and a head support 30 are connected. Two-thirds of the way up the stanchion 26, at approximately shoulder height of a seated user, a substantially horizontal cross beam 32 is provided, which has flanges 34 at its ends extending substantially perpendicularly to the cross beam 32 in the direction of the seat portion 24. Attached to each flange 34 is a respective movable section 36.

One end of a first movable part 38, which, when in an intended rest position, extends substantially vertically downwards, is connected to the flange 34 by a pivot 40. One end of a second movable part 42 is connected to the other end of the first movable part 38 by a pivot 44. A handle 46 is provided at the other end of the second movable part 42. The handle 46 may be passively rotatable to allow pronation and/or supination of the forearm. The pivots 40 and 44 are both substantially horizontal and substantially parallel to the cross beam 32. Pulleys 48*a* and 48*b* are connected to the cross beam 32 and a cam 50 is connected to the second movable part 42 and is co-axial with the pivot 44. On the inside of the second movable part 42 is an elbow pad 52. At rest, the second movable part 42 is directed downwardly, although not necessarily vertically.

A cable (not shown) is attached to the pulley 20 on the weight stack 14 and passes through the second pulley 22. This is then fed around pulleys 48*a* and 48*b* and attached to the respective cams 50 on each movable section 36.

When in use, the user (not shown) sits on seat portion 24, with their back against back support 28 and their head against head support 30. The seat portion is adjustable to ensure the user is at the correct height. The user positions their elbows on the respective elbow pads 52 and grips the handles 46. This positions the user's shoulders in line with the first connection 42, and their elbows in line with the second connection 44. The user moves their arms forward and upwards such that the first movable part 38 is brought up to, or beyond, the horizontal position. The handle 46 is lifted so that the angle formed between the upper surfaces of the first movable part 38 and the second movable part 42 is decreased during one movement through the full range of motion of the machine. At the end of the full range of motion of the apparatus, the first movable part 38 will be substantially horizontal, or creating a reflex angle between the intended underside of the flange 34 and the first movable part 38. In the position, the second movable part 42 may be substantially vertical, or beyond, thereby creating a reflex angle between the undersides of the first movable part 38 and the second movable part 42. Clearly, the finishing angles at the end of the range of motion will vary according to the user and they may fall short of these indicated positions. These movements, that is, movement of the first movable part 38 and the second movable part 42, may be done simultaneously or in stages depending upon the exercise required.

During the movement of the movable section 36, a resistive force is felt by the user due to the weight stack. The cams 50*a* and 50*b* provide a load so that a force is required from the user to lift the weight stack 14 and move the movable section 36 the full range of motion. The load on the first part 38 may be varied by changing the shape, which may include changing the radius, of the cams 50 and/or changing the cable connection point on the radius of the cam 50 with respect to the first connection 40. Rotation of the first movable part 38 about pivot 40 exercises the shoulder joint and muscles associated therewith; the shoulder attachment of the bicep. Rotation of the second movable part 42 about pivot 44 exercises the elbow joint and muscles associated therewith; the elbow attachment of the bicep.

Figure 2:
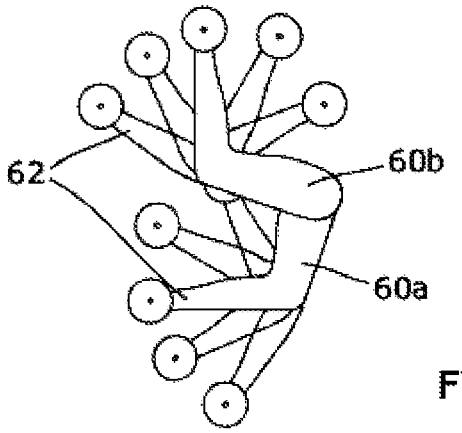
FIG. 2 shows the effective motion of a user's arm when operating the embodiment of FIG. 1.

FIG. 2 shows the effecting movement of the user's arm whilst using the apparatus shown in FIG. 1. 60*a* shows a possible start position of the user's upper arm, wherein the first movable part 38 is in a rest position. 60*b* shows the user's arm in a final position, wherein the first movable part 38 have been forced through to the end point of the full range of motion. The user's forearm 62 may be moved through the positions shown in the Figure.

Figure 3:
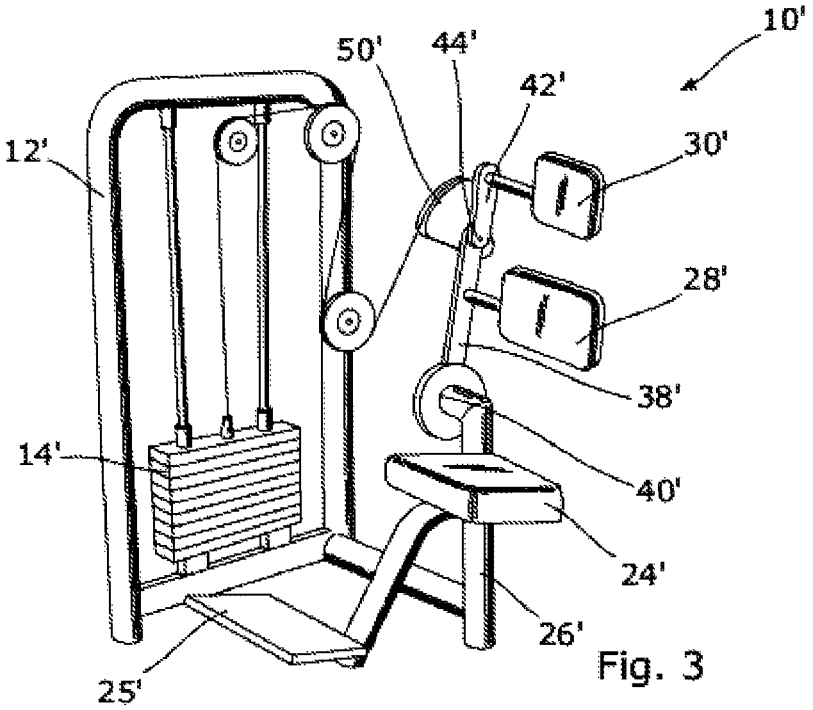
FIG. 3 shows a second embodiment of the present invention.

FIG. 3 shows a second embodiment of the present invention showing apparatus 10' for exercising the back and neck of a user. This second embodiment comprises a framework 12' housing a weight stack 14'. A seat portion 24' is provided connected by its intended back corner nearest the weight stack 14' to the outside surface of a stanchion 26'. The seat portion 24' is arranged perpendicularly to the weight stack 14'. The stanchion 26' extends substantially vertically up to a point at approximately the lumbar region of a user's lower back. At the lower end of the stanchion, a foot support 25' is provided.

A first movable part 38' is connected at one end to the top of the stanchion 26' by pivot 40'. The first movable part 38' extends upwardly and substantially vertically. Approximately half-way up the first movable part 38', in the region of the user's shoulder-blades, is a back support 28'. A second movable part 42' is connected at one end to the other end of the first movable part by pivot 44'. The second movable part 42' is provided with a head support 30' at the other end, and a cam 50' is provided at the pivot 44', coaxially therewith. A cable (not shown) links the cam 50' to the weight stack 14'.

When in use the user adopts a seated position on the seat portion 24' and places their back and head against the back support 28' and the head support 30', respectively. The user's feet are positioned on the foot support 25' in order to assist with stabilising the user and assist with providing a force to counteract the resistive force provided by the weight stack 14. The user forces their back against the back support 28' thereby moving the first movable part 38 and uses their head against the head support 30' to move the second movable part 42. By introducing a force on the movable section 36' via the user's back and neck, the cam 50' and cable (not shown) are able to translate that force into vertical movement of the weight stack 14.

Figure 4:
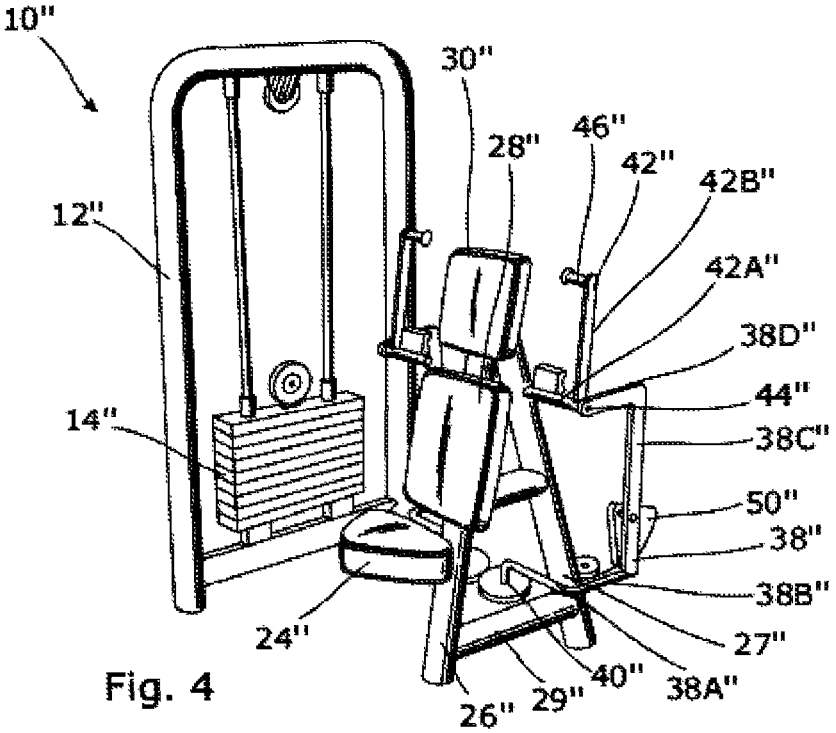
FIG. 4 shows a third embodiment of the present invention.

The apparatus 10" shown in FIG. 4 is intended to resist transverse adduction and internal rotation of a user's shoulders, which replicates a throwing action or an overheard movement of a racquet. The apparatus 10" comprises a framework 12", a weight stack 14", a seat portion 24" connected to a first stanchion 26" and spaced away from the weight stack 14" facing in a direction substantially parallel to the plane thereof. Attached to the first stanchion 26" is a back support 28" which ends at a point approximately just below a user's shoulder blades. A second stanchion 27" is positioned behind the first stanchion 26" and connected thereto at their respective upper ends. A cross member 29" connects the two stanchions 26" and 27" at their lower ends, thereby forming a triangle comprising the stanchions 26" and 27" and the cross member 29", in a plane substantially parallel to the weight stack 14. A head support 30" is arranged adjacent to the top of the triangle formed by the stanchions and above the seat portion 24".

Two arm portions 38", each constituting a first movable part, are pivotally connected to and extend from the cross member 29" at a point 40". The arm portions 38" comprise a first part 38A" extending respectively outwardly from the cross member 29", substantially perpendicularly thereto. A first end of a second part 38B" extends perpendicularly to the first part 38A" and away from the first stanchion 26" parallel to the plane of the stanchions 26" and 27". A third part 38C" extending substantially vertically is connected at its first end to the other end of second part 38B". The other end of third part 38C" is attached to a fourth part 38D", which is substantially parallel to second part 38B", extends towards the first stanchion 26". Parts 38B", 38C" and 38D" form a shape substantially resembling a reverse C-shape that pivots at connection 40".

At the other end of the fourth part 38D", a second movable part 42" is pivotally connected at connection 44". The second movable part 42" comprises a first section 42A", which is connected to the pivot 44" at its first end and extends coaxially with the pivot 44" in the direction of the stanchion 26", and a second section 42B" extends perpendicularly to the first section 42A" and upwardly in a generally vertical direction at a position adjacent the first end of the first section 42A". The second end of the first part 42A" is not connected to any further parts other than an arm pad 54" attached adjacent the other end thereof. A cam 50" is pivotally connected to the third part 38C" of the first movable part 38" and is positioned approximately a third of the way along its length. The cam 50" is connected to the weight stack and to the second movable part 42" via cables (not shown) that run through pulleys. The other end of the second section of the second movable part 42B" is provided with a handle 46".

The user is positioned on the seat portion 24" and grips the handles 46" with their hands. This results in the user's upper arms being substantially horizontal and extending in the coronal plane, with the forearms being substantially vertical in the same plane. As the user performs adduction of their shoulder and internal rotation of the shoulder, the machine 10 provides resistance to the movement of first part 38" rotating from behind the user's shoulders to in front of the user; the two parts 38", and associated second parts 42" rotating towards one another. The end position of the user is that the forearm (and second movable part 42") is substantially horizontal and extends across the user's body, parallel with their chest, and the upper arm (and first movable part 38") extends perpendicularly to the shoulder (and horizontal section 38A" of the wing portion 38") extending forward, in front of the user.

Figure 5:
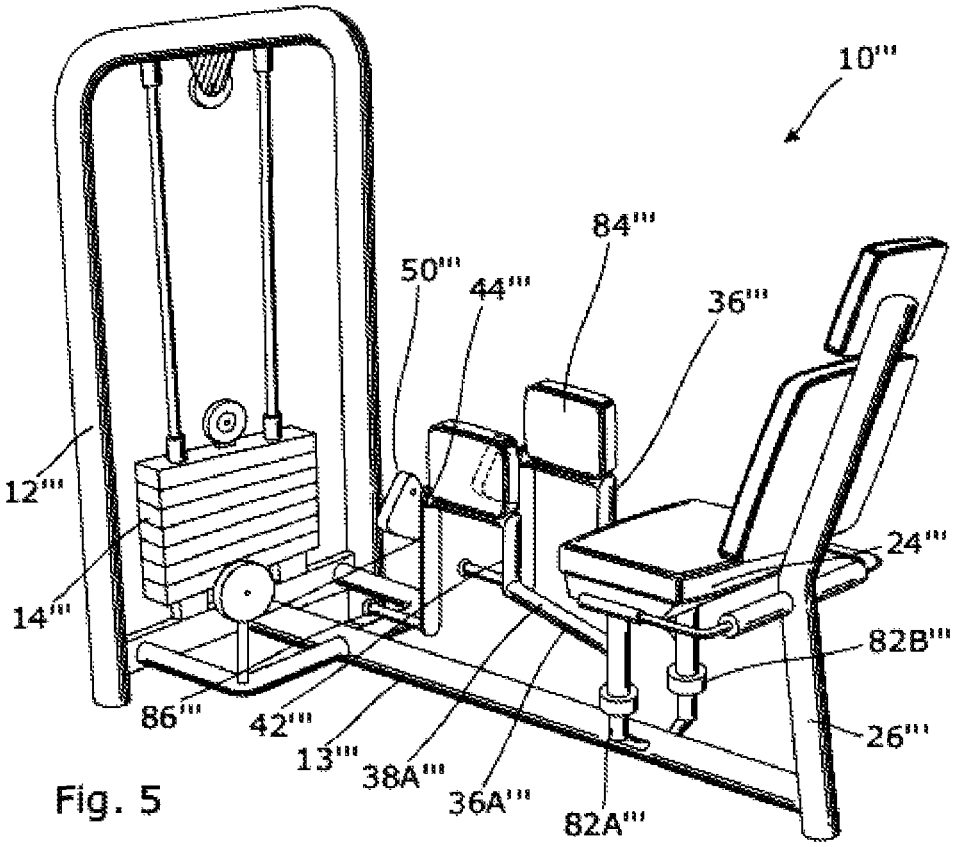
FIG. 5 shows a fourth embodiment of the present invention.

The apparatus 10'" shown in FIG. 5 is intended to resist forces created by a user's muscles in performing adduction and external rotation of the user's hip. This movement is seen in, for example, football, where a player passes the ball with the inside of their foot.

The apparatus comprises a framework 12'" housing a weight stack 14'". A first end of a substantially horizontal elongate extension 13'" is positioned substantially perpendicularly to the midpoint of the base of the framework 12'". The other end of the extension 13'" is provided with a substantially vertical stanchion 26'", which supports the back of a seat portion 24'". The seat portion 24'" is arranged so that a user faces the weight stack 14'" when using the apparatus.

Substantially vertical legs 82A'" and 82B'" are situated along the length of the elongate extension 13'", one either side of a centre line along the axis and on the upper surface of the extension. The vertical legs 82A'" and 82B'" support the front of seat portion 24'". Pivotally attached to the legs 82A'" and 82B'" are respective movable sections 36A'" and 36B'", which extend substantially parallel with the extension 13'" and toward the weight stack 14'". Each movable section comprises a first movable part 38'" pivotally connected at one end to the leg 82'", extending on an upward angle and comprising a knee support 84'" adjacent to the other end. At the other end of the first movable part 38'", a second movable part 42'" is connect via a pivot 44'", extending substantially vertically downwards. A foot support 86'" is attached to the other end of the second movable part 42'". The first movable part 38'" rotates in the transverse plane, that is, swinging in an arc in a substantially horizontal plane, and the second movable 42'" part is able to rotate in the coronal plane, from a substantially vertical position, towards the other second movable part 42'" and up to being in a horizontal position.

The user (not shown) sits in the seat portion 24'" and aligns their legs on the outside of the movable parts 36'", resting their knees on the knee supports 84'" and each of their feet on the foot supports 86". By adducting the user's legs, the user's knees move closer together against the resistance provided by the weight stack 14'". Subsequent rotation of the hip swings the foot from a substantially vertical position into a more horizontal position, again, against the resistance from the weight stack 14'".

Figure 6:
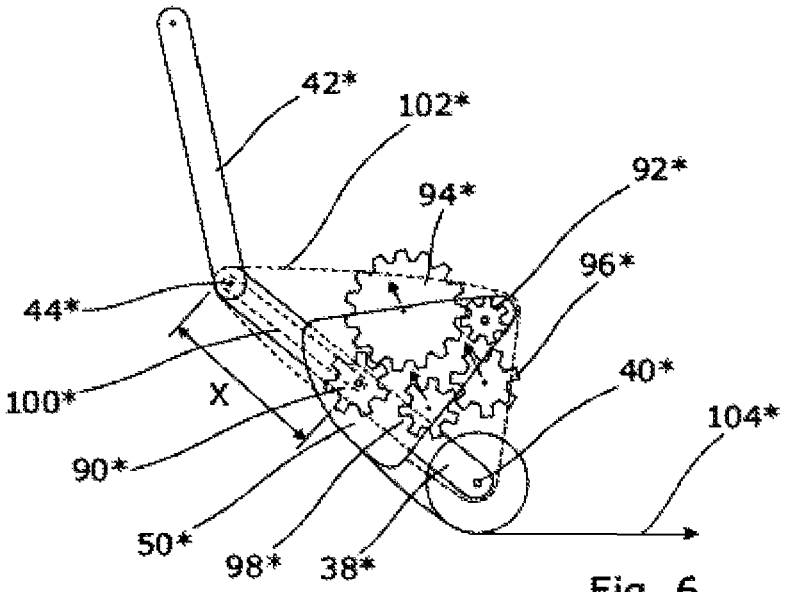
FIG. 6 shows a fifth embodiment of the present invention.

FIG. 6 shows a further embodiment of the part of present invention, which may, for example, be applied to apparatus such as that shown in FIG. 1, although it could be applied to any of the previously described embodiments. A first movable part 38* is connected to a framework (not shown) by pivot 40*. Pivotally connected to the opposite end of the first movable part 38* by a pivot 44* is a second movable part 42*. A cam 50* is attached to the first movable part 38* in a position offset from the length of that part.

Approximately midway along the length of the first part 38* is a first gear wheel 90*, which is able to rotate about its centre. At the axis of the cam 50* a second gear wheel 92* is provided which is spaced apart from the first gear wheel 90* and is fixed to the cam 50* such that when the cam 50* rotates, so does the second gear wheel. A three-position gearbox is provided which comprises a third gear wheel 94* on one side of an imaginary line connecting the axis of the first gear wheel 90* and the second gear wheel 92*, and a fourth gear wheel 96* and a fifth gear wheel 98*, which are engaged and positioned on the opposite side of the imaginary line connecting the first gear wheel 90* and the second gear wheel 92*. The gear box may be put in a first position, wherein third gear wheel 94* engages both the first gear wheel 90* and the second gear wheel 92*; a second position (not shown) wherein the fourth gear wheel 96* engages the second gear wheel 92* and the fifth gear wheel 98* engages the first gear wheel 90*; or a third position (not shown) where none of the gear box gear wheels 94*, 96* and 98* engage the first gear wheel 90* or the second gear wheel 92*. The first gear wheel 90* is linked to the second movable part 42* such that when the second movable part 42* rotates clockwise about pivot 44*, gear wheel 90* also rotates clockwise. The link may be formed by a chain 100* connecting a further gear wheel (not shown) positioned coaxially with pivot 44* and attached to the second movable part 42*. A casing (indicated by dashed line 102*) is provided to reduce the risk of a foreign body jamming the gear wheels within the gearbox. Length X is provided with means for adjusting the length of the first movable part 38* so as to be adjusted for user's having different arm lengths. Cam 50* is attached to the weight stack (not shown) via cable 104*.

In the first position of the gearbox, when the first gear wheel 90* is rotated in an anti-clockwise manner, second gear wheel 92* is also rotated in an anti-clockwise manner due to the link created by the third gear wheel 94*. With the gearbox in the second position, when the first gear wheel 90* is rotated in an anti-clockwise direction the second gear wheel 92* rotates in a clockwise direction due to the link between them formed by the fourth and fifth gear wheels 96* and 98*; the link reverses the direction of rotation of the second gear wheel 92* with respect to the first 90*. When the gearbox is in the third, or neutral, position, none of the gearbox gear wheels engage the first and/or second gear wheels 90* and 92*, therefore the second movable part 42* can be adjusted without having an effect on the cam 50*.

Introducing the gear assembly of FIG. 6 allows the creation of a "neutral position" and a "reverse gear" thereby enabling the apparatus to be used in a different manner. As an example, it may be desirable to be able to reverse the movement of the second parts 42 of the apparatus shown in FIG. 1 so that their start position is substantially perpendicular to the first part 38; in such a configuration extending the apparatus through the full range of motion exercises the tricep. Such reversal may be used for converting a 'chest press' movement into a 'chest fly' movement. This allows the apparatus to be more suitable for exercising antagonistic pairs, thereby reducing the floor space required for fixed-weight machines as the one machine is capable of doing more than one exercise.

Figure 7:
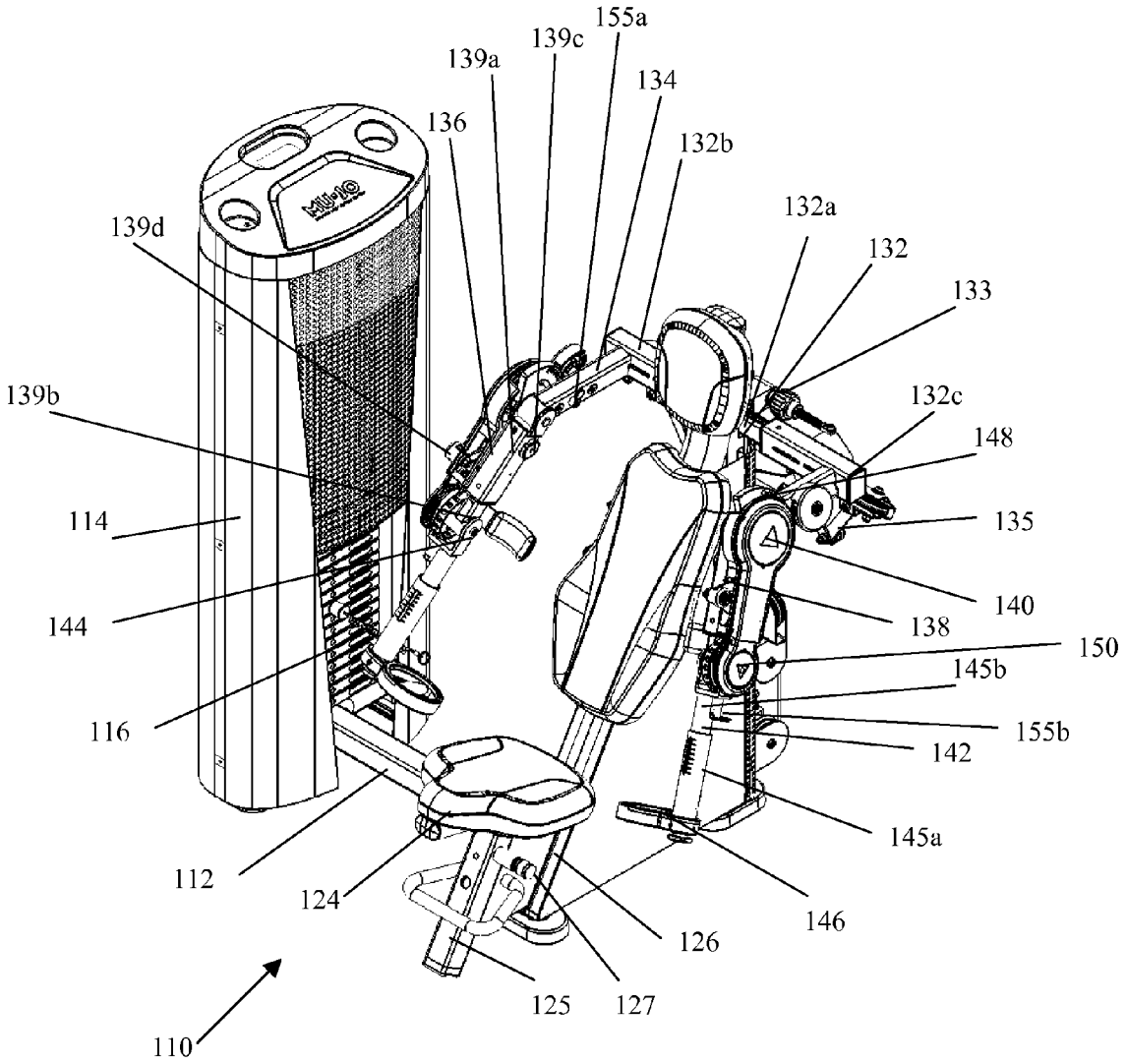
FIG. 7 shows a sixth embodiment of the present invention.

FIG. 7 shows a fixed weight exercise machine 110, which is similar to that shown in FIG. 1 and works in a similar manner to that embodiment, although the machine 110 shown in FIG. 6 has some additional features over the machine 10 shown in FIG. 1. The device 100 comprises a framework 112, housing a weight stack 114 which comprises weight plates 116, selectively connected to a vertical shaft (not shown) in a similar manner to that shown in FIG. 1.

A seat portion 124 is provided and is slidably connected to a vertical stanchion 126 at its rear side and having a substantially vertical leg 125 extending from the underneath of the seat portion 124. The seat portion 124 is height adjustable using a pin 127 to lock the seat portion 124 at the desired height.

A cross-member 132, which is equivalent to, and performs the same function as, cross beam 32 in FIG. 1, comprises a central section 132*a*. Sleeves 132*b* and 132*c* engage the respective ends of the central section 132*a* and are able to slide along the central section 132*a*. A screw-threaded adjustment member 133 is connected to the framework 112 and is also connected to the sleeves 132*b* and 132*c* in order to control the position of the sleeves 132*b* and 132*c* relative to the central section 132*a*. Rotation of the screw-threaded adjustment member 133 displaces the position of the sleeves 132*b* and 132*c* relative to the central section 132. A tensioner device 135, which may be in the form of a biased tensioning assembly, is provided to ensure that the cable remains taut regardless of the position of the sleeve 132*b* and 132*c* and the distance therebetween. A movable section 136, equivalent to section 36 on FIG. 1, is connected to the sleeve 132*c*, via extensions 134, such that it extends towards the user, when in use. Therefore, adjustment of the lateral position of the sleeve 132*c* using the adjustment member 133 allows for the distance between the movable sections 136 to be altered, thereby allowing users of different sizes to user a single machine. A second screw-threaded member (not shown) is provided to allow independent adjustment of the other sleeve 132*b*.

It will be appreciated that the machine 110 could be adapted so that independent adjustment of the sleeves 132*b* and 132*c* is possible using two adjustment members 133 to control the lateral position of both sleeves 132*b* and 132*c*.

Extensions 134 are fixedly attached to the sleeves 132*b* and 132*c*, which protrude towards an intended position of a user, although the extensions may be pivotally connected rather than fixedly attached in further embodiments not shown. Respective first movable parts 138, equivalent to part 38 on FIG. 1, are provided and connected to the extensions 134 at pivot 140 and extend therefrom. The first movable part 138 is provided with a first length adjustment mechanism 139. This mechanism comprises a sleeve 139*a* having an elongate part 139*b* contained therein. The elongate part 139*b* can slide within the sleeve 139*a* and is adjusted using a turn knob 139*c*. Turning knob 139*c* slides elongate part into or out of the sleeve 139*a*, thereby adjusting the length of the first movable part 138. A tensioner 139*d* is provided to ensure that as the position of the elongate part 139*b* is adjusted, the tension in the cable (not shown) is maintained. The tensioner 139*d* is in the form of a biased and hinged two-piece arm member.

Second movable parts 142 are connected to the first movable parts 138 at pivot 144, which are, again, comparable to parts 42 of FIG. 1. These second movable parts 142 are provided with an adjustment mechanism 145, which comprises a slidable section 145*a* that surrounds an elongate portion 145*b* and has a locking system to retain the slidable section 145*a* in position. An adjustment control knob is provided that, when rotated, adjusts the position of the elongate portion 145*b* with respect to the slidable section 145*a*, thereby allowing control of the length of the second movable part 142.

The adjustment mechanisms takes account of a user's shoulder width, upper arm length and lower arm length, and allows the machine 110 to be used by different sized and shaped users. This reduces the risk of injury as the machine 110 can be altered to ensure correct alignment with the user's joints.

Rotatable hand grips 146 are connected to the ends of the second movable parts 142, which allow a user to comfortably move through their range of motion without putting rotational stress on their wrist.

Range of movement limiters 155*a* and 155*b* ensure that the movable parts 138 and 142, respectively, are not extended beyond a predetermined position. They limiters comprise a plate member attached to one part, the plate member having a groove therein and the pin engaging that groove. This prevents a user from over-reaching beyond their range of movement and reduces the risk of damage to the machine 110. Alternatively, one movable part may be fixed in position by passing a separate pin through a hole in the plate member, thereby locking the part in place. This allows a user to restrict movement of the machine to a single joint rather than exercising two joints at the same time.

The device 110 is operated in a similar manner to the device 10 shown in FIG. 1, taking into account the adjustable features of the device 110.

Figure 8:
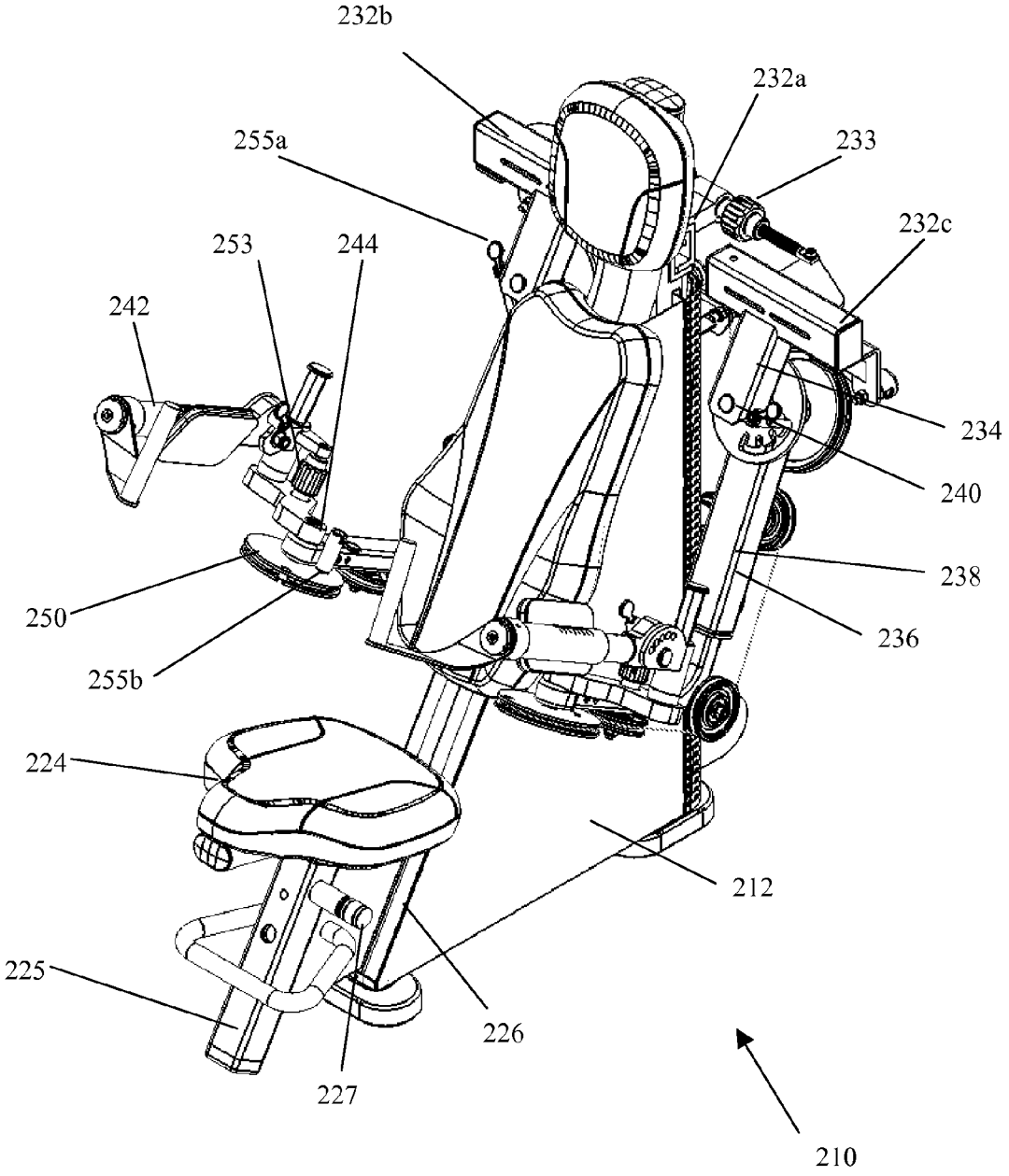
FIG. 8 shows a seventh embodiment of the present invention.

FIG. 8 shows a shoulder external rotation machine 210 having many common features as the other embodiments of exercise machines shown in the other Figures. The framework 212 houses a weight stack (not shown) similar to that shown in FIG. 7. The machine 210 comprises an adjustable seat portion 224 having a substantially vertical leg 225 and slidably engaged into substantially vertical stanchion 226. A locking pin 227 is provided for setting the height of the seat portion 224 and retaining it in place.

A cross-member 232 is provided and a similar mechanism to that shown in FIG. 7 is used. Sleeves 232*b* and 232*c* are slidably positioned over central section 232*a*. As with the machine of FIG. 7, the position of the sleeves 232*b* and 232*c* along the length of substantially horizontal central section 232*a* may be adjusted in order to accommodate users of different shoulder width. A rotational adjustment member 233 is used to control the position of the sleeves 232*b* and 232*c*.

Extensions 234 are provided on each sleeve 232*b* and 232*c*, which are in turn connected to respective movable sections 236. A first part 238 of the movable section 236 is connected to the extension 234 at a pivot connection 240. A second movable part 242 is connected to the first movable part at pivot 244 and a moving axis cam 250 is connected at the same point to the second movable part 242. Length adjustment of the second movable part 242 can be undertaken at passive elbow adjustment means 253 joint that equates to the position of a user's elbow, when in use, by using a turn knob.

Tensioning devices are provided to ensure the cable remains taut during adjustment of the machine 210 to fit a user.

Range of movement limiters are provided 255*a* and 255*b* to prevent the first and second parts from passing beyond a pre-determined position.

Figure 9:
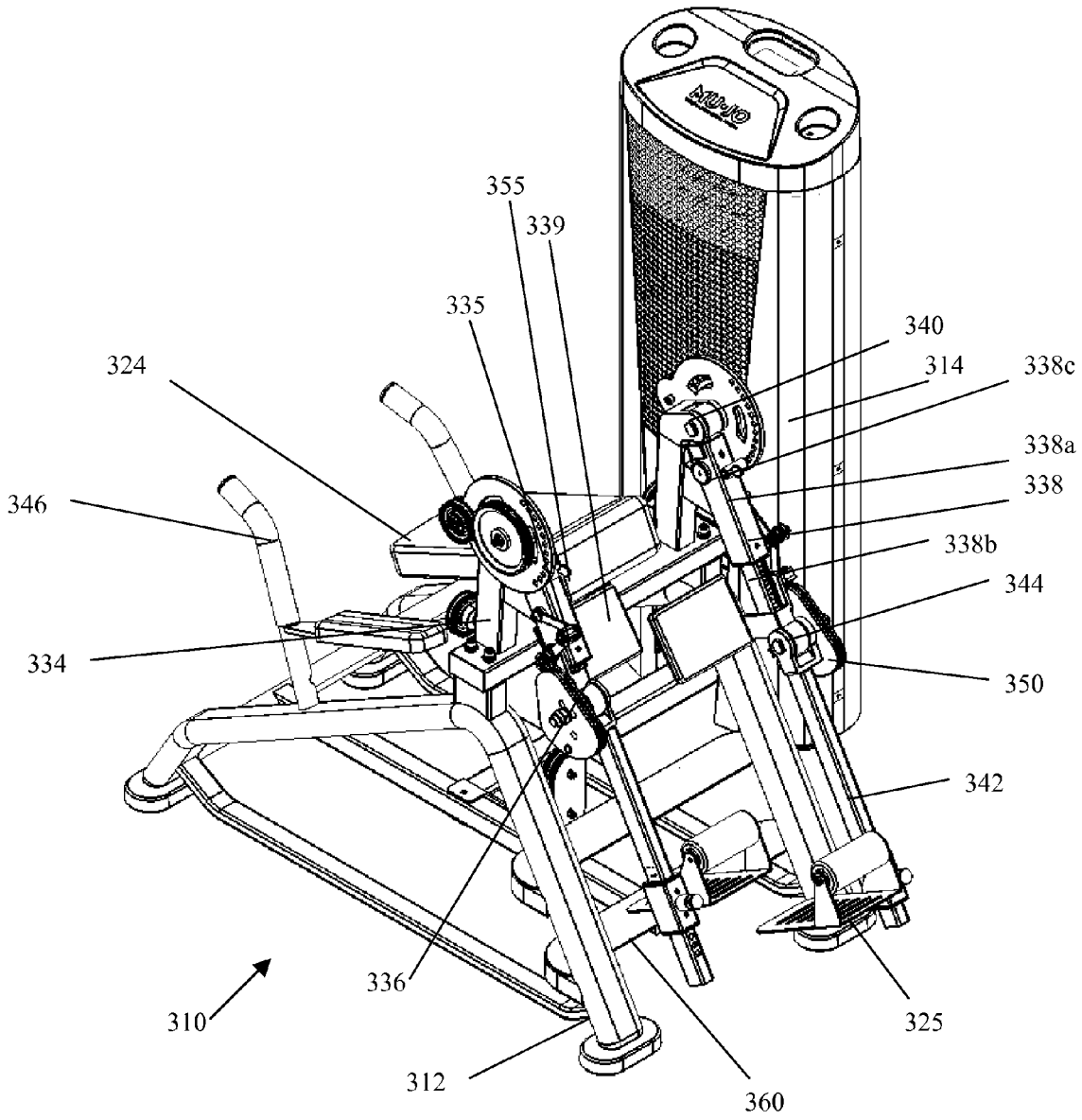
FIG. 9 shows an eighth embodiment of the present invention.

FIG. 9 shows a hamstring exercise machine 310 comprising a framework 312 housing a weight stack 314. The framework 312 is effectively in the form of two a-frames connected at their apices by a cross-member, and connected at various other points to increase stability and rigidity. The framework is provided with a user support portion 324 on one of its upper sides. Part way down the same side of the framework 312 as the support portion 324, are two handle portions 346, one connected to each effective a-frame of the framework 312.

The apices of each effective a-frame are each connected to the lower end of a substantially vertical extension section 334. A pivotally connected movable section 336 is attached at the other end of the extension section 334. The movable section comprises a first movable part 338 connected at one end to the extension section 334 at pivot 340. The other end of first movable part 338 is connected to a second movable part 342 at pivot 344. The second movable part 342 is connected via the pivot to a moving axis cam 350 at the same pivot point 344.

The first movable part 338 comprises a first section 338*a* into which is slidably received a second section 338*b* and can be held in place by way of locking means 338*c*. The locking means 338*c* are in the form of a rotatable handle, wherein rotation in one direction allows for the first section 338*a* to be extended or retracted within the second section 338*b*. The arrangement of the first section 338*a* and the second section 338*b* allows for the length of the first movable part 338 to be adjusted. Leg pads 339 are provided along the length of the second section 338*b*. The first movable part 338 is provided with a link tensioner 335 in order to keep the cable (not shown) taut when the length of the first movable 338 part is adjusted.

The second movable part 342 is provided at its lower end with an adjustable foot plate 325, the position of which relative to the second movable part may be altered using a pin-locking mechanism.

Steps 360 are provided between the movable sections 336 to assist with a user mounting and dismounting the machine 310.

Adjustable range of motion limiters 355 are provided to limit the range of movement of the movable section 336. These comprise a plate member connected to the movable parts 338 and 342 and having a groove therein and a pin that can be inserted into the grove, thereby limited the movement available for the plate. Additional locking means are provided to lock a movable part in place to allow a single joint to be exercised.

When in use, the user embarks the machine 310 and lays face-down over the framework 312. The user positions their torso on the user support portion 324 and grips the handles 346. The first movable parts 338 should be adjusted so that the leg pads 339 are positioned beneath the user's thighs. The foot plates 325 are then adjusted to ensure that the user's feet are in the correct position and that the second movable part 342 is of a sufficient length to operate the machine 310. The user then exercises their hamstrings against the resistive force of the weight stack. The use of the first movable part and the second movable parts in combination allows for exercising of the user's hips and a full range of motion of the hamstring muscles.

Figure 10:
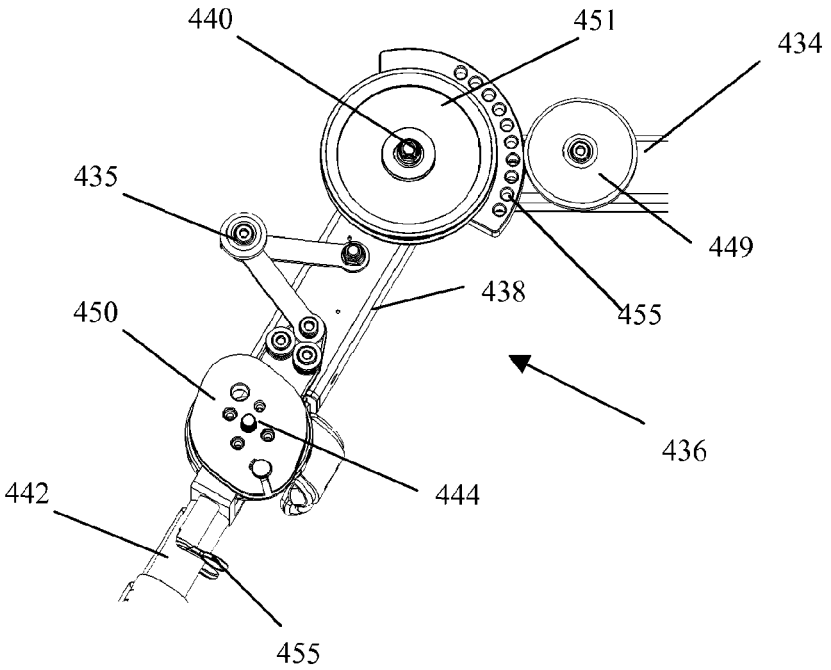
FIG. 10 shows a perspective side view of a cam arrangement for use with the present invention.
Figure 11:
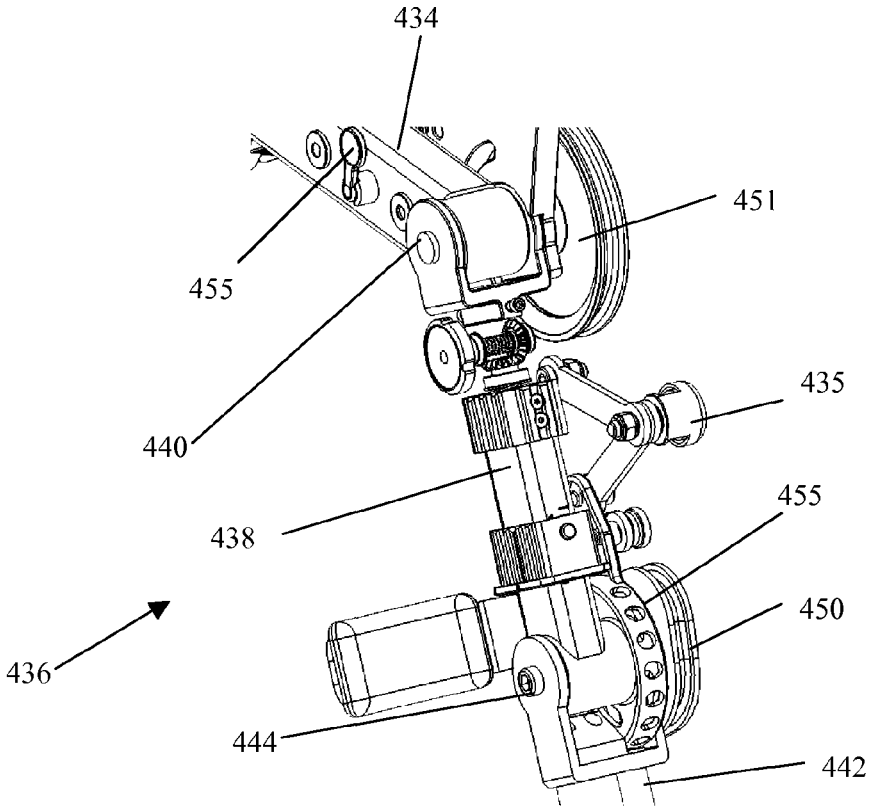
FIG. 11 shows an exploded perspective view of the cam arrangement of FIG. 10.

FIGS. 10 and 11 show an example movable section 436 in more detail. The movable section comprises a first movable part 438 connected to a second movable part 442 and pivot 440. The pivot 444 connects the second movable part and a moving axis cam 450, such that when one rotates, the other does as well. A guide pulley 449 and a fixed pulley 451 are provided on the extension section 434 and the first movable part 438, respectively. A cable (not shown) passes over the guide pulley 449 and the fixed pulley 451 and passes to the cam 450. A tensioner mechanism 435 is provided along the cable path in order to retain tension in the cable when the length of the first movable part 438 and is adjusted. Range of motion limiters 455 are provided to limit the movement of the joint between the extension section 434 and the first movable part 438 and the first movable part and the second movable part 442, in order to reduce the risk of damage to the machine and/or the user.

Guide pulleys are positioned on the devices disclosed in the drawings to guide a cable between the cam and the weight-stack. Various pads are positioned on the exercise machines to assist with comfort and support.

The range of motion limiters can be positioned so as to lock a joint of the exercise machine, thereby locking the first movable part or second movable part in place. This enables a user to exercise a single joint in isolation.

It may be desirable to use a pin-locking mechanism for adjusting the lengths of the first and second movable parts.

Where the cam is co-axial with the pivot between the first part 38 and the second part 42 and attached to the second part, the torque and/or linear force required to overcome the resistive force in the first part 38 is greater than that required in the second part 42. Wherein multi-axial exercises are undertaken, for example, as in FIG. 5, the force required to overcome the resistive force in the first part 38''' will be greater than that required in the second part 42''' when the radius of the cam 50''' is less that the length of 36A'''.

In order to adjust the torque required to overcome the resistive force, the cam may be moved along the length of the first and/or second part of the movable section. The movement may be via one or more predetermined discrete positions or along a continuous sliding positioning system. By adjusting the position of the cam(s), the torque required to move each part 38 and 42 of the movable section 36 can be adjusted so that the torque required in the first part is greater or less than that in the second part, depending upon the desired exercise. For example, it may be desirable to have the torque in the second part of the movable section significantly less than that of the first part of the movable section in the embodiment shown in FIG. 3 so that the neck is not strained and the back provides more of the required torque.

Whilst the cam is usually positioned co-axially with pivot 44, it may be positioned perpendicularly to the pivot 44, or at an angle therebetween. By having the cam set at such an angle, resistance is provided to the movement of the second part 38, allowing for rotational movement of a user's joint. It may be desirable to set the angle between perpendicular and parallel to the second member in order to acquire the correct level of translational and rotational movement required. It may also be desirable to employ a guide pulley on the cam in order to keep the angle with the second part 42 consistent during movement of the first part 38; the guide member rotates the cam to a predetermined angle depending upon the amount that the first part 38 has pivoted on its pivot 40. It may be further desirable to have a guide pulley attached to the first part 38 that maintains the angle of the cable onto the cam 50 as the first part 38 moves inwardly, for example, during shoulder transverse adduction.

In a further construction, the centre of rotation of the cam may be offset from the axis of the pivot 44 by a distance, thereby effectively creating a different cam profile, as shown in FIG. 4. The cam may be translated to the different position by attaching a flange to the first part 38 and/or second part 42 and fixing the respective cam thereto. Rather than having the cam in a permanent offset position, it may be advantageous to have an adjustable cam attached to a rail so that the amount of offset from the axis of the pivot can be adjusted either on a continuous rail or rail comprising discrete predetermined locations.

The cam may be connected to the first part 38 of the movable section 36, with the second part 42 being passive. In such a construction, the resistance is mainly felt through the first part 38 and the second part 42 is able to pivot or rotate in order to keep the body part in a natural position. For example, the forearm can be rotated whilst the shoulder is rotated so that the user is more comfortable and the whole are follows a more natural path.

Example applications for the present invention include, but are not intended to be limited to:

Ankle
Plantar flexion, inversion
Dorsal flexion, eversion
Plantar flexion, eversion
Dorsal flexion, inversion
Lower leg
Ankle plantar flexion, knee flexion
Ankle dorsal flexion, knee extension
Ankle plantar flexion, knee extension
Ankle dorsal flexion, knee flexion
Knee
Flexion, internal rotation
Flexion, external rotation
Extension, internal rotation
Extension, external rotation
Thigh
Knee flexion, hip extension
Knee extension, hip flexion
Knee extension, hip extension
Knee flexion, hip flexion
Hip
Adduction, external rotation
Abduction, internal rotation
Adduction, internal rotation
Abduction, external rotation
Extension, knee flexion
Hip flexion, knee extension
Spine
Thoracolumbar lateral flexion
Thoracolumbar rotation
Thoracolumbar anterior flexion (abdominals)
Neck and head lateral flexion, flexion, extension
Extension
Clavicle
Scapula elevation, shoulder abduction
Scapula depression, shoulder adduction
Scapula abduction, shoulder transverse flexion
Scapula adduction, shoulder transverse extension
Shoulder
Transverse abduction, external rotation
Transverse adduction, internal rotation
Abduction, external rotation
Adduction, internal rotation
Upper arm
Shoulder transverse abduction, elbow extension
Shoulder transverse adduction, elbow flexion
Shoulder abduction, elbow flexion
Shoulder adduction, elbow extension
Shoulder flexion, elbow flexion
Shoulder extension, elbow extension
Shoulder transverse flexion, elbow extension
Shoulder transverse extension, elbow flexion
Shoulder abduction, elbow extension
Shoulder adduction, elbow flexion
Elbow
Extension, pronation
Flexion, supination
Forearm
Elbow flexion, wrist flexion
Elbow extension, wrist extension In each case, movement might be desirable in a number of other additional planes. As an example, shoulder transverse abduction and external rotation might follow a path of shoulder transverse abduction and extension, both combined with external rotation.

Further movement may be introduced to the apparatus, for example passive rotation of a handle or foot support, where present. Alternatively, the handle or foot support may be provided with a resistive force, advantageously, through the use of a 3-dimensional cam.

At least one pulley may be pivoted in order to guide the cable that links the resistive force and the movable section. This allows for the cable to always be directed towards the respective cam during the range of motion.

A pulley guiding a connection cable to the cam may be positioned so as to provide a rotational torque through the whole range of motion of the first part. This may be by positioning the axis of rotation of the pulley concentrically to the axis of rotation of the first connection. Alternatively, the pulley may be offset.

Wherein a machine has a starting position of an outwardly extending, substantially horizontal arm and exercises adduction of the arm towards the sagittal plane and beyond towards the coronal plane again, along with flexion of the elbow, for example in FIG. 4, it may be desirable for the connection between the first movable part 38" and the second movable part 42" to be a 'ball and socket', thereby allowing more natural movement of the arm, including rotation of the forearm, during the complete range of motion. This replicates movement of a tennis racquet during a forehand shot. Alternatively, the connection between the first movable part and the second movable part may comprise two or more pivots to provide rotation in multiple planes, preferably, two pivots orthogonally orientated. This may be applied to any connection in the apparatus.

In embodiments of the invention wherein the cam is positioned at a position along the length of the first part, the distance between the cam and the second connection may be varied to adjust the distance between the first and second connections, thereby allowing the apparatus to be adjustable to adapt to variations in user limb length. Similarly, the distance between the handle (where present) and the second connection may be adjusted. These adjustments may be coupled together so that only one adjustment is needed to change the relative length of the first and second parts. It may be preferable for other parts of the apparatus to be adjustable to allow for variations in user size. The cam may be positioned along the length of one of the parts and also offset from the axis of the same part so that when viewed from one side, the position, and maybe axis, of the cam forms a triangle with the first and second connections. Offsetting the position of the cam in two or three dimensions from the line of one of the movable parts can assist with varying the resultant resistive force experienced by the movable section.

The cam may be provided with a weight (or counterweight) to increase or decrease the torque required to move it when the apparatus is in use.

The pivots 40 and 44 may allow for displacement in multiple planes, for example with a ball and socket pivot mechanism, thereby providing a movement in several degrees of freedom. This may be useful, for example, in combination with the embodiment shown in FIG. 5, wherein the knee joint may be extended during the movement of the user's, more closely resembling the action of passing a football.

Although the described embodiments refer to the use of a seat portion, it may be desirable for the user to be in a standing or reclined position, including lying down, thereby negating the need for a seat.

In addition to the disclosed uses, or as an alternative, the apparatus can be used for cardio-vascular exercises.

Whilst the movable parts may be described as being connected at their respective ends, this is intended to mean adjacent to, or in the region of, the ends. It may also mean along the length of the second of the part, for example if the part is shaped in a particular way that results in the second part being connected along the length of the first part but not necessarily at the end. It is advantageous if the second part is connected in the second half of the length of the first part if it is not connected to the end thereof.

Resistance may be provided, for example, by a weight-stack, fly-wheel, a piston and cylinder arrangement, or resistance band, or a combination thereof. The resistance may be in the form of weights attached directly to the first and/or second movable parts, rather than via a cable. A piston and cylinder arrangement may comprise a piston and cylinder attached to the first part and resisting movement thereof, and a second piston and cylinder arrangement attached to the second part and resisting movement thereof. Clearly, other resistance means may be used in place of the piston and cylinder arrangements, for example two weigh-stacks connected to the respective parts. The resistance may be variable during the range of motion so that a muscle can be overloaded when it reaches a predetermined position. This might be effected by use of a piston and cylinder arrangement or by adding mass to a weight stack. Alternatively, the increased/decreased resistance may be produced by use of a, or the, cam. By providing the cam with a particular profile, it may be possible to significantly increase or decrease the resistance in order to vary the muscle workload; eccentric resistive force. Adjusting the radius of the cam and/or the position thereof will also adjust the torque required to overcome the resistive force, as will adjusting the lengths of the first and second parts to adjust the position of the cam.

Other link mechanisms may be used for the creation of a gearbox arrangement, as exemplified in FIG. 6, including, but not limited to, a reversible band or a piston and cylinder arrangement.

"Fixed weight" is intended to mean that during operation of the apparatus, the resistance is attached to the movable section using pulleys position, unlike free-weights wherein the user may move in any direction or combination of directions in an unrestricted manner.

"Cable" is intended to cover the use of chains, ropes, belts, wires and other connecting means. The connecting means may comprise one or more gears, or cogs, to connect the resistive force to the movable section.

The "sagittal", "coronal" and "transverse" planes are intended to mean planes parallel thereto, sometime referred to as "parasagittal", etc.

"Swing" is intended to comprise movement that encompasses linear and/or angular motion. Therefore, a first movable part may be movable in a linear fashion and a second part movable in an angular fashion.

The first and second movable parts are substantially elongate and may be positioned to reflect the location of a user's limb or body part. "elongate" is intended to mean its length of the part is significantly longer than its other dimensions.

Using a gear box arrangement, it is possible to reverse movements of at least some of the arrangements described herein, thereby increasing the number of muscles that can be exercised using a single machine.

The invention claimed is:

1. Muscle resistance apparatus comprising a framework, a user support member attached to the framework upon which at least part of a user's body weight can be supported in use, means for producing at least one resistive force and a movable section, the movable section being linked at least one position along its length to the, or each, resistive force, wherein a first elongate part of the movable section is attached to the framework by a connection whereby the first elongate part can be displaced, and a second elongate part of the movable section is connected to the first part of the movable section by a second connection whereby the second elongate part can be displaced, and wherein, in use, the first and second parts of the movable section are independently movable with respect to one another in an angular and/or linear fashion and the resistive force is applied to both the first and second parts wherein the apparatus comprises at least one range of motion limiter to lock a joint of the apparatus.

2. Apparatus according to claim 1, wherein at least part of the movable section can be moved in multiple-directions.

3. Apparatus according to claim 1, wherein the resistive force is applied via at least two pulleys so as to provide rotational loading of both the first part and the second part of the movable section.

4. Apparatus according to claim 3, wherein the first pulley is attached to the framework and the second pulley is attached to the moveable section.

5. Apparatus according to claim 3, wherein the first pulley is orientated so as to be parallel with the plane of movement of the first part and the second pulley is orientated so as to be parallel with the plane of movement of the second part.

6. Apparatus according to claim 1, wherein the link between the movable section and the at least one resistive force comprises at least one variable load cam.

7. Apparatus according to claim 6, wherein the cam is positioned adjacent to the second connection of the movable section.

8. Apparatus according to claim 6, wherein the cam is connected to the first movable part at a position wherein the axis of rotation of the cam is offset from the axis of rotation of the connection and the cam is linked to the second movable part by way of a cable.

9. Apparatus according to claim 1, wherein the first connection and the second connection are aligned to allow movement substantially within a single plane.

10. Apparatus according to claim 1, wherein the first connection and the second connection are aligned to allow movement, in use, of the first part of the movable section within a plane selected from a group comprising sagittal, coronal and transverse planes, and to allow movement of the second part of the movable section within a different plane selected from the same group.

11. Apparatus according to claim 1, wherein the second connection of the movable section allows for axial rotation of the second part of the movable section relative to the first.

12. Apparatus according to claim 1, wherein at least one connection allows at least one of the movable parts to swing.

13. Apparatus according to claim 1, wherein the distance between the first and second connections is adjustable in order to allow the joint to be aligned with a user's limb length.

* * * * *